United States Patent [19]

Murray

[11] Patent Number: 4,631,006

[45] Date of Patent: Dec. 23, 1986

[54] COMPACT VACUUM PUMP

[75] Inventor: Gary P. Murray, Montpelier, Ohio

[73] Assignee: Robinair Division, Montpelier, Ohio

[21] Appl. No.: 703,185

[22] Filed: Feb. 19, 1985

[51] Int. Cl.[4] ..... F04C 25/02; F04C 29/08

[52] U.S. Cl. ..... 417/234; 417/360; 137/855; 418/270

[58] Field of Search ..... 417/234, 410, 360; 418/97, 270, DIG. 1; 137/855

[56] References Cited

U.S. PATENT DOCUMENTS

| | | | |
|---|---|---|---|
| 2,739,537 | 3/1956 | Sadler et al. | 417/410 X |
| 3,117,419 | 1/1964 | Brolund | 417/234 X |
| 3,314,599 | 4/1967 | Rollinger et al. | 418/DIG. 1 |
| 3,838,950 | 10/1974 | Andriulis | 418/97 X |
| 4,088,428 | 5/1978 | Bannistes et al. | 418/270 X |
| 4,123,201 | 10/1978 | Andriulis | 417/360 X |

*Primary Examiner*—Carlton R. Croyle

*Assistant Examiner*—Theodore Olds

*Attorney, Agent, or Firm*—Beaman & Beaman

[57] ABSTRACT

The invention pertains to a lightweight and concise vaccum pump particularly suitable for servicing refrigeration systems. One end of a cylindrical electric motor casing is enclosed by a substantially cylindrical adapter upon which a pump assembly is mounted. The motor armature shaft extends through the adapter and the pump rotor is directly mounted thereon. A hollow shell affixed to the adapter encompasses the pump assembly defining a chamber thereabout which includes a lubrication sump. A synthetic plastic handle assembly attaches to the motor casing and includes a capacitor housing and a base is affixed to the lower side of the casing. Except for the handle and base the pump is of a substantially cylindrical configuration of a diameter similar to that of the motor casing, and the pump assembly includes lubrication and exhaust features which provide improved pumping conditions.

2 Claims, 8 Drawing Figures

COMPACT VACUUM PUMP

BACKGROUND OF THE INVENTION

Vacuum pumps for refrigeration system servicing must be portable and readily transportable by service personnel. Such vacuum pumps basically conist of an electric motor having pump apparatus attached to one end of the motor and driven thereby, and refrigeration servicing vacuum pumps are usually of the single or double stage type, typical examples being shown in the assignee's U.S. Pat. Nos. 3,791,780; 3,837,764 and 3,982,864.

The vacuum producing capabilities of refrigeration servicing pumps may vary in accord with the system being evacuated, and in many service calls for domestic refrigerators, home air conditioning units, such as window units, and other relatively small refrigeration systems, a vacuum pump of relatively limited capacity is most suitable. While many refrigeration systems could be serviced by relatively small capacity vacuum pumps, because of marketing and pricing factors, smaller capacity vacuum pumps have not been available wherein excellent vacuum achieving capabilities have been combined with concise configuration and low cost.

It is an object of the invention to provide a lightweight and concise vacuum pump which is readily transportable and easy to use.

Another object of the invention is to provide a concise vacuum pump utilizing a motor casing wherein a dielectric handle assembly is mounted on the casing incorporating the motor capacitor.

A further object of the invention is to provide a concise vacuum pump including an adapter and pump assembly shell wherein the configuration of these components is substantially cylindrical and of a diameter substantially corresponding to that of the motor casing.

An additional object of the invention is to provide a concise vacuum pump having a pump rotor directly mounted upon the electric motor armature shaft, and wherein passages are provided for improving lubrication of the pump to insure an effective extended operating life.

Yet another object of the invention is to provide a concise vacuum pump having a pump assembly employing an exhaust riser protecting a reed valve, and utilizing a vapor discharge which aids in separating exhausted gas and vapors from oil.

In the practice of the invention a cylindrical electric motor casing is closed at one end with a conventional end plate, and a cylindrical adapter encloses the other casing end. Tie rods maintain the end plate and adapter in position, and the motor armature shaft is rotatably mounted upon bearings located on the end plate and adapter.

The adapter includes a pump assembly mounting base defined thereon to which is bolted a pump assembly including a rotor eccentrically oriented within a cylindrical cavity and the rotor employs outwardly biased vanes engaging the cavity circumference to form a vane-type pump. A hollow shell encompasses the pump assembly defining a chamber thereabout, and forming a sump for the lubricating oil as well as a space for receiving the gases exhausted from the pump wherein separation of exhausted gas and lubricating oil vapor and droplets takes place.

A synthetic plastic housing assembly is directly mounted upon the motor casing and includes a portion enclosing the motor capacitor, and a handle portion extends thereabove to permit ease of carrying of the pump. An electric switch is mounted upon the handle assembly at the end of the capacitor housing portion.

A base assembly including elastic foot pads is attached to the lower region of the motor casing upon which the unit rests.

The motor armature shaft extends through the adapter and the pump rotor is directly mounted thereon. Other features of the pump include the use of a spacer metering washer having a lubricating oil passage defined therein whereby lubricating oil is drawn at a metered rate from the sump into the pump assembly, and the pump assembly includes an end plate having a passage in communication with the metering washer or spacer for distributing oil to the pump cavity. The adapter mounting base also includes a lubricating passage communicating with the sump.

Another feature of the pump is the utilization of an exhaust riser which is attached to the pump assembly and is vertically oriented for housing the reed valve and reed valve limiter associated with the pump exhaust orifice. A distribution conduit affixed to the upper region of the exhaust riser communicating with the shell chamber and extending through the baffle screen aids in separating gas and oil particles. The exhaust orifice, at the pump cavity surface, is relieved to define a packet to produce an increased volume and dimension at the exhaust port which increases the effective pressure on the exhaust reed valve causing the valve to open earlier in the cycle than would otherwise occur which improves the vacuum attainable.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
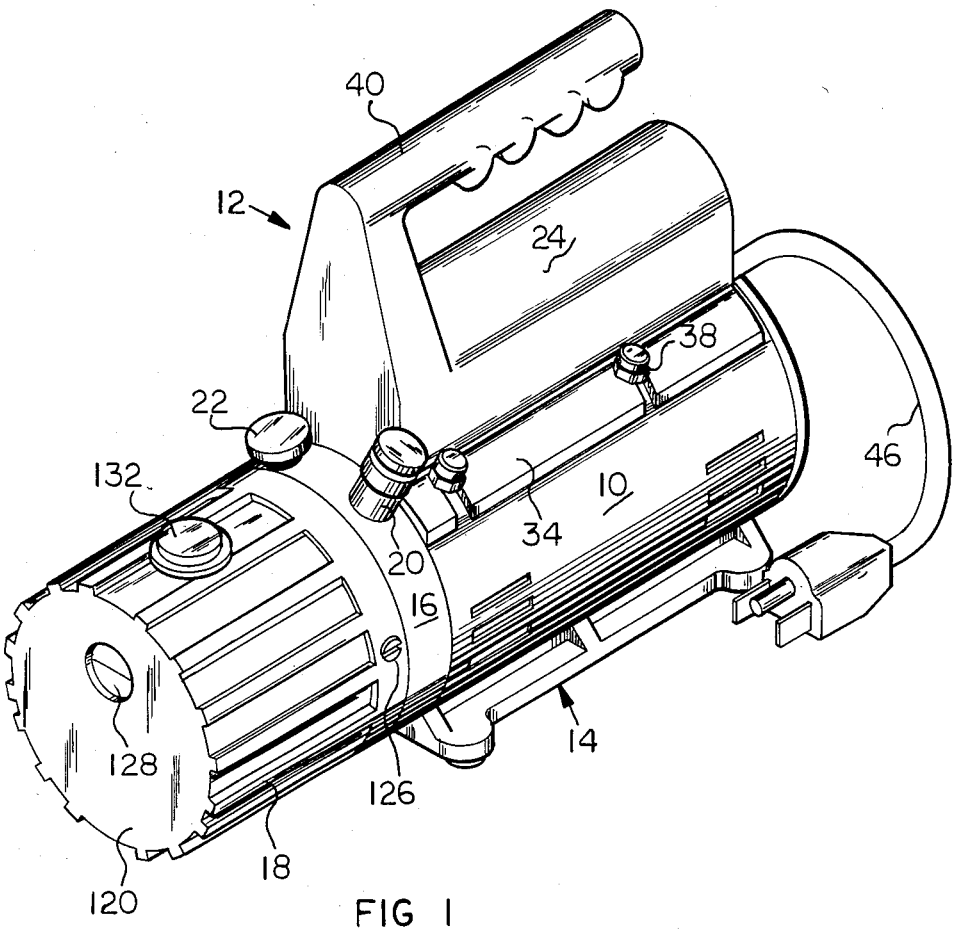
FIG. 1 is a perspective view of a vacuum pump in accord with the invention.

With reference to FIG. 1, a vacuum pump in accord with the invention includes a cylindrical motor casing 10 which is closed at each end, and at its upper region a handle assembly 12 is mounted, while the base assembly 14 is affixed to the casing lower region. An adapter 16 is attached to one end of the casing and the hollow shell 18 affixed to the adapter encompasses the pump assembly, later described. The pump inlet fitting 20 attaches to the adapter and communicates through suitable passages with the pump, and the gas ballast fitting 22 is also defined in the adapter.

The handle assembly 12 is formed of a synthetic dielectric material such as polycarbonate and is molded of the configuration appreciated from FIGS. 1–4. The handle assembly includes a lower region 24 defining a cavity 26 for receiving the motor capacity 28, and a cavity 30 in which the motor switch 32 is mounted. Downwardly extending flanges 34 are formed on the handle assembly and include slots for receiving motor casing studs 36 whereby nuts 38 attach the handle assembly to the upper region of the motor casing. The handle assembly includes the upwardly extending handle portion 40 formed above the capacitor housing portion 24 and ribs are defined thereon for facilitating gripping wherein the pump is readily carried by the handle 40. The weight distribution is such that the center of gravity extends through handle 40.

Figure 3:
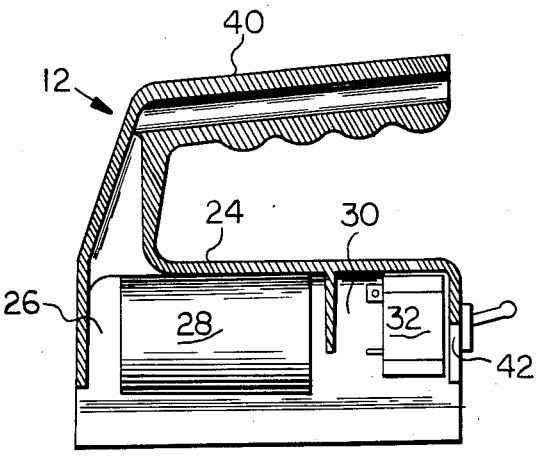
FIG. 3 is an elevational, detail, sectional view of the handle assembly.
Figure 2:
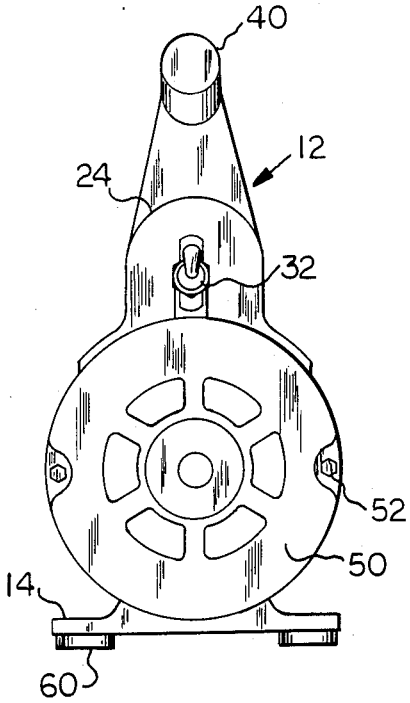
FIG. 2 is an end elevational view of the pump as taken from the right of FIG. 1.
Figure 4:
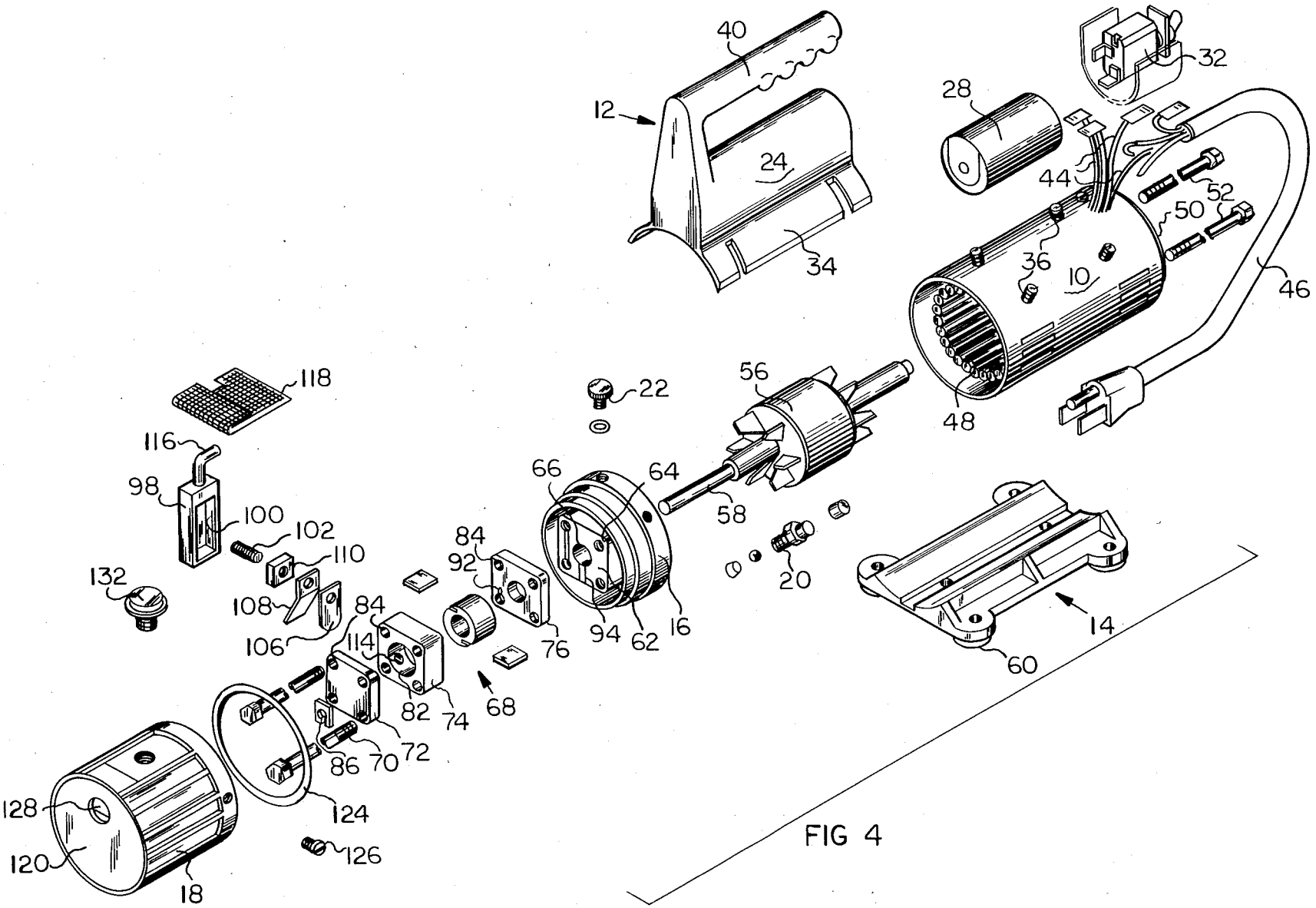
FIG. 4 is an exploded, perspective view of the major components of a vacuum pump in accord with the invention.

As will be appreciated from FIGS. 2 and 3, the rear vertical wall of the handle assembly includes an opening 42 through which the motor switch 32 is mounted, and by suitable conductors 44, FIG. 4, the capacitor 28, switch 32, and supply lead 46 are connected to the other motor electrical components such as the field coil 48, FIG. 4.

The rear open end of the motor casing is enclosed by end plate 50 and the other end of the motor casing is enclosed by the adapter 16. Tie rods 52 extend through the end plate and motor casing and thread into the adapter to maintain the assembly of these components. Ball bearings, not shown, mounted within the end plate 50 and ball bearings 54 within the adapter, FIG. 5, rotatably support the motor armature 56 which includes the shaft 58 which extends through the adapter.

The base assembly 14 is bolted to the lower region of the motor casing elastic foot pads for supporting the pump upon a flat surface. As will be appreciated from FIGS. 1 and 2, the width of the base assembly 14 is approximately equal to the diameter of the motor casing 10 such that the base assembly does not add undesirable bulk to the pump. Likewise, it is to be noted that the diameter of the adapter 16 is substantially equal to that of the diameter of the motor casing, and the maximum diameter of the shell 18 substantially corresponds to that of the adapter. Thus, the assembly of the motor casing, adapter and shell results in a generally elongated cylindrical configuration which is of pleasing appearance, yet of concise configuration.

Figure 5:
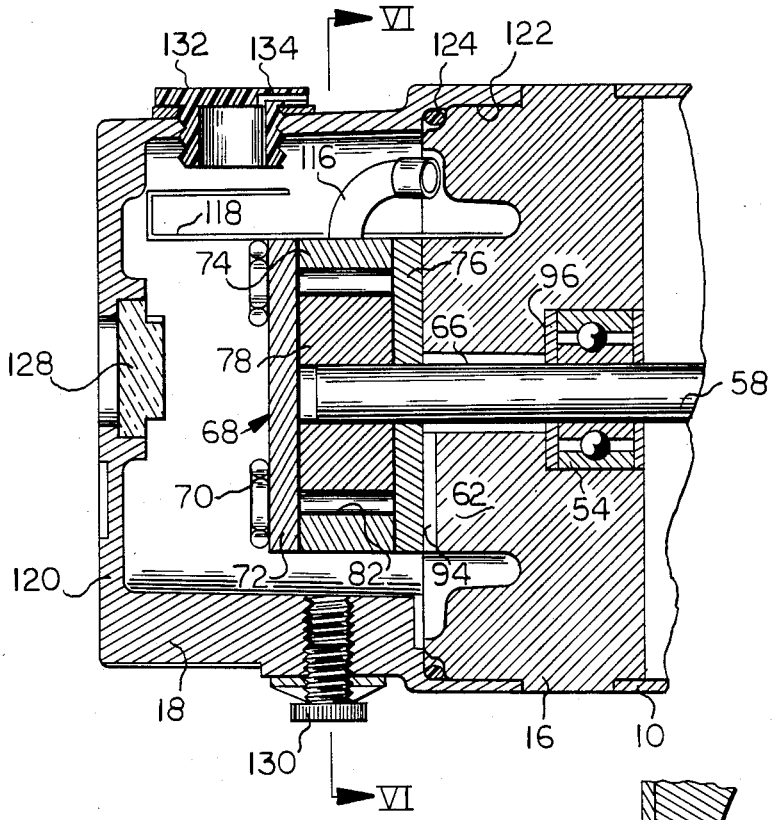
FIG. 5 is an elevational, sectional view of the adapter, pump and shell.

As apparent in FIGS. 4 and 5, the adapter 16 which is diecast of aluminum, on the side remote from the motor, includes a rectangular pump mounting base 62 having four threaded holes 64 defined therein. The hole 66 defined in the adapter receives the motor shaft permitting the motor shaft 58 to extend into the pump assembly generally indicated at 68. The pump assembly is mounted upon the adapter mounting base 62 by four cap screws 70 which thread into the holes 64.

The pump assembly 68 includes an outer end plate 72, a central pump block 74, an inner end plate 76, and the rotor 78 in which the vanes 80 are mounted for radial displacement. The rotor 78 is keyed to the motor shaft 58.

Figure 6:
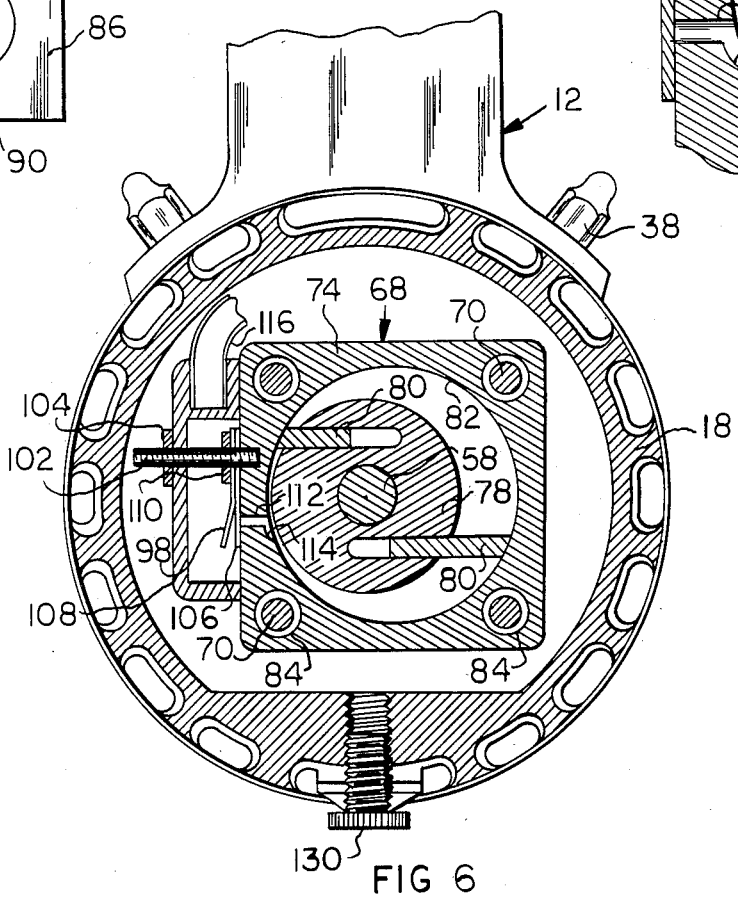
FIG. 6 is an elevational, sectional view taken through the pump and shell along Section VI—VI of FIG. 5.

The pump block 74 includes a cylindrical cavity surface 82 which is eccentrically oriented to the center of the motor shaft 58 and the rotor 78, FIG. 6. Thus, as the pump rotor rotates and the outer ends of the vanes 80 engage the cavity surface 82, the vanes will be displaced inwardly and outwardly with respect to the rotor, and in the known manner, a pumping action occurs in view of the communication of the inlet fitting 20 with the cavity and the communication of an exhaust port with the cavity, as later described.

Figure 7:
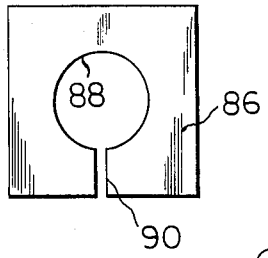
FIG. 7 is an enlarged, elevational view of the oil inlet spacer.
Figure 8:
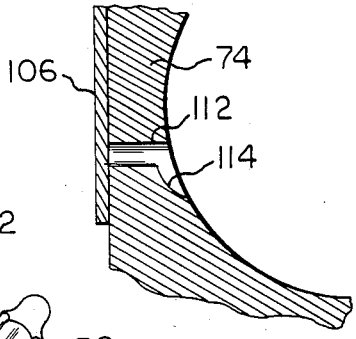
FIG. 8 is an enlarged, detail, sectional view of the pump block illustrating the exhaust port.

The diameter of the cap screw receiving holes 84 defined in the end plates and pump block are slightly greater than the diameter of the cap screws 70 wherein the clearance between the cap screw and the associated hole may constitute a passage for lubricating oil. In the practice of the invention the lower left cap screw, FIG. 6, has an oil inlet metering spacer 86 inserted under the head thereof and this spacer includes a hole 88, FIG. 7, which receives the cap screw and a metering passage 90 communicating with the hole and the lower edge of the spacer. Thus, with the head of the associated cap screw 70 engaging the oil spacer 86 a passage under the cap screw head into the associated hole in end plate 72 is defined. As will be noted in FIG. 4 a groove 92 is formed in the end plate surface adjacent the cavity 82 and in communication with the cavity wherein lubricating oil entering the passage 90 may flow through the cap screw hole and groove to enter the pump cavity. This flow path for lubricating oil insures adequate lubrication oil within the pumping chamber for lubricating and sealing purposes.

An oiling channel 94 is also defined in the die cast adapter mounting base 62 extending between the central opening and lower edge of the mounting base. This channel permits oil to be drawn into the adapter 16 for providing lubrication of the external shaft seal 96 adjacent the adapter bearing 54 for supporting the motor shaft.

As best illustrated in FIG. 6, an exhaust riser assembly is affixed to the pump block 74. The exhaust riser includes a rectangular housing 98 having an opening 100, FIG. 4, defined therein which engages the side of the pump block. A threaded stud 102 located within a threaded hole in the pump block extends through the riser and by means of nut 104 maintains the riser against the block 74. A flexible reed valve 106 is held against the block over the exhaust port and is mounted upon the threaded stud 102 as is a reed valve limiter 108 adjacent the reed valve and a nut 110 mounted on the stud simultaneously positions the reed valve and reed valve limiter.

The exhaust port 112 defined in the pump block 74 extends from the cavity surface 82 through the block to the reed valve 106, and in its normal position the reed valve maintains the exhaust port closed. The port is provided with a recess or pocket 114 at the cavity surface 82 which extends in a circumferential direction greater than that of the exhaust port dimension providing a pocket at the inlet of the port which permits the pressure of the gases being exhausted to be imposed upon the reed valve 106 at an earlier time in the pumping cycle than would otherwise be possible, and this earlier imposition of the exhaust pressure on the reed valve increases the pressure on the reed valve at an earlier time in the pumping cycle which produces an improvement in the attainable vaucum as compared to an arrangement where the pocket were not present.

The exhaust riser 98 is provided with an angled conduit 116 at its upper end communicating with the interior of the riser, and the upper portion of the conduit is horizontally disposed extending toward the adapter 16. A baffle screen 118 is located immediately above the exhaust riser and the conduit extends therethrough, FIG. 5. Gases exhausting through the port 112 enter the exhaust riser housing and are expelled through the conduit 116 in a direction toward the adapter.

The shell 18 is of a hollow configuration having a closed end 120 and an inner open end. The open end is provided with a cylindrical surface which closely engages the cylindrical adapter shoulder 122, FIG. 5, and an O-ring seal 124 between the shell and adapter assures a liquid-tight interconnection. The shell is maintained on the adapter by a pair of diametrically opposed screws 126 threaded into the adapter.

The outer closed adapter end 120 is provided with a transparent sight window 128 wherein the level of the lubricant within the shell chamber may be observed. The shell is provided with a drain plug 130, and at its upper region the threaded exhaust port receives an exhaust cap 132 having an outlet passage 134 defined therein communicating with the interior of the shell chamber. Thus, exhaust gases expelled into the shell chamber through the exhaust riser 98 and conduit 116 leave the shell through the cap passage.

In operation the inlet fitting 20 is connected to the refrigeration system by a rubber hose in the conventional manner and the pump motor is energized by the switch 32. Through appropriate passages, the inlet fitting communicates with the interior of the pump cavity 82 and the refrigeration system is evacuated. During pumping, oil is drawn into the pump block 74 through the metering passage 90 and groove 92, and the exhausted gases and lubricating oil particles are expelled into the shell chamber surrounding the pump assembly 68. The baffle screen 118 permits the oil vapors to return to the oil within the shell chamber, and the exhausted gases escape the shell through the exhaust cap 132. The oil within the air space of the shell chamber will drop back into the lubricating oil reservoir and sump.

The use of the adapter plate 16 simultaneously functions as a motor end bell housing and a support for the motor bearing, and simultaneously serves to support the pump assembly 68 and the necessary shaft seal, and also provides the structure for the inlet and gas ballast fittings.

The mounting of the pump rotor directly upon the motor shaft eliminates the need for additional seals and bearings as is the case wherein the pump rotor shaft is independently mounted upon its own bearings and coupled to the motor shaft.

The apparatus of the invention permits an effective pump to be produced in a concise and lightweight configuration. The described features assure proper lubrication and maximum efficiency during the pumping cycle, and the use of the adapter and shell minimize fabrication costs and reduce assembly time. It is appreciated that various modifications to the inventive concepts may be apparent to those skilled in the art without departing from the spirit and scope of the invention.

I claim:

1. A vacuum pump characterized by its light weight and concise configuration comprising, in combination, an electric motor having a substantially cylindrical casing having first and second open ends and upper and lower regions, a base affixed to said casing lower region, a one-piece handle assembly affixed to the exterior of said casing upper region, said handle assembly including a lower capacitor housing disposed adjacent the exterior of said casing upper region and an upper hand grip homogeneously extending above said capacitor housing, flanges homogeneously defined on said handle assembly extending downwardly from said capacitor housing in engagement with said casing upper region, fasteners attaching said flanges to said casing upper region, a motor capacitor located within said capacitor housing, an end plate mounted upon and enclosing said casing first end, a pump-motor adapter mounted upon and enclosing said casing second end, tie rods connected to said adapter extending through said end plate and casing mounting said end plate and adapter upon the associated casing end, a motor armature within said casing rotatably mounted upon said end plate and adapter having a shaft extending through said adapter, said adapter having a cyindrical exterior configuration having a maximum diameter substantially corresponding to the motor casing diameter and concentric therewith, a pump assembly mounting base defined upon said adapter, said shaft extending through said mounting base, a pump assembly mounted upon said mounting base including a pump rotor directly mounted upon said armature shaft, a substantially cylindrical shell having an inner open end and an outer closed end enclosing said pump assembly and defining a chamber about said pump assembly, said shell having a diameter substantially corresponding to the diameter of said motor casing and adapter and concentric therewith, said shell open end being sealingly mounted upon said adapter, an inlet port defined in said adapter in communication with said pump assembly, an exhaust port defined in said pump assembly in communication with said chamber, an outlet port defined in said shell in communication with said chanber, said pump assembly including a rotor block having a cavity defined by a circumferential surface, vanes mounted upon said pump rotor engaging said cavity circumferential surface, said pump assembly exhaust port including an exhaust orifice defined in said rotor block intersecting said circumferential surface and the exterior of said rotor block, a relief pocket defined in said cavity circumferential surface intersecting said exhaust orifice having a circumferential dimension greater than that of said orifice, a resilient reed valve mounted on the exterior of said rotor block controlling egress through said orifice, said relief pocket increasing the effective gas pressure upon said reed valve during exhausting, an exhaust riser mounted upon the exterior of said rotor block, said riser comprising a hollow vertically oriented jacket having an upper end and an opening disposed toward said rotor block, a single threaded shaft extending through said jacket and said reed valve threaded into said rotor block, first and second nuts threaded on said shaft holding said reed valve and said jacket against said rotor block, respectively, said reed valve extending through said jacket opening and located within said jacket, and an exhaust deflector conduit mounted on said jacket extending from the upper end thereof in communication with said jacket and having a horizontally disposed discharge for discharging exhausted gas into said chamber.

2. A vacuum pump characterized by its light weight and concise configuration comprising, in combination, an electric motor having a substantially cylindrical casing having first and second open ends and upper and lower regions, a base affixed to said casing lower region, a handle assembly affixed to said casing upper region, an end plate mounted upon and enclosing said casing first end, a pump-motor adapter mounted upon and enclosing said casing second end, tie rods connected to said adapter extending through said end plate and casing mounting said end plate and adapter upon the associated casing end, a motor armature within said casing rotatably mounted upon said end plate and adapter having a shaft extending through said adapter, a pump assembly mounting base defined upon said adapter, said shaft extending through said mounting base, a pump assembly mounted upon said mounting base including a pump rotor directly mounted upon said armature shaft, said pump assembly including a rotor block having a cavity defined by a circumferential surface, vanes mounted upon said pump rotor engaging said cavity circumferential surface, an exhaust orifice defined in said rotor block intersecting said circumferential surface and the exterior of said rotor block, a relief pocket defined in said cavity circumferential surface intersecting said exhaust orifice having a circumferential dimension along said circumferential surface greater than the diameter of said orifice, a resilient reed valve mounted on the exterior of said rotor block controlling egress through said orifice, said relief pocket increasing the effective gas pressure upon said reed valve during exhausting, an exhaust riser mounted upon the exterior of said rotor block, said riser comprising a hollow vertically oriented jacket having an upper end and an opening disposed toward said rotor block, a single threaded shaft extending through said jacket and said reed valve threaded into said rotor block, first and second nuts threaded on said threaded shaft holding said valve and said jacket against said rotor block, respectively, said reed valve extending through said jacket opening and located within said jacket, an exhaust deflector conduit mounted on said jacket extending from the upper end thereof in communication with said jacket and having a horizontally disposed discharge, a substantially cylindrical shell having an inner open end and an outer closed end enclosing said pump assembly and defining a chamber about said pump assembly, said shell open end being sealingly mounted upon said adapter, an inlet port defined in said adapter in communication with said pump assembly, and an outlet port defined in said shell in communication with said chamber, said exhaust deflector conduit discharging exhausted gas into said shell chamber.

* * * * *